United States Patent [19]

Miyaki et al.

[11] Patent Number: 4,492,534

[45] Date of Patent: Jan. 8, 1985

[54] FUEL INJECTION PUMP FOR INTERNAL COMBUSTION ENGINE

[75] Inventors: Masahiko Miyaki, Oobu; Akira Masuda; Toshimi Matsumura, both of Aichi, all of Japan

[73] Assignee: Nippondenso Co., Ltd., Kariya, Japan

[21] Appl. No.: 538,994

[22] Filed: Oct. 4, 1983

[30] Foreign Application Priority Data

Oct. 5, 1982 [JP] Japan ..... 57-175665

[51] Int. Cl.[3] ..... F04B 35/02; F04B 19/02; F02M 39/00

[52] U.S. Cl. ..... 417/386; 417/462; 123/450

[58] Field of Search ..... 417/252, 253, 383, 388, 417/462, 385, 386; 123/450, 458, 501

[56] References Cited

U.S. PATENT DOCUMENTS

| | | | |
|---|---|---|---|
| 3,107,661 | 10/1963 | Kemp | 417/462 |
| 3,506,381 | 4/1970 | Kemp | 123/450 |
| 3,598,507 | 8/1971 | Voit et al. | 417/505 |
| 3,880,131 | 4/1975 | Twaddell et al. | 123/500 |
| 4,401,076 | 8/1983 | Sano et al. | 123/501 X |
| 4,428,346 | 1/1984 | Hoshi | 417/462 X |
| 4,445,822 | 5/1984 | Hoshi | 417/462 X |

FOREIGN PATENT DOCUMENTS

| | | | |
|---|---|---|---|
| 246055 | 7/1963 | Australia | 123/450 |
| WO81/00283 | 2/1981 | PCT Int'l Appl. | 123/501 |
| 1210234 | 10/1970 | United Kingdom | 417/462 |

*Primary Examiner*—William L. Freeh
*Assistant Examiner*—Paul F. Neils
*Attorney, Agent, or Firm*—Cushman, Darby & Cushman

[57] ABSTRACT

Fuel injection pump of the type arranged to inject fuel into engine cylinders with the fuel flow being controlled by an electromagnetic valve, comprises a rotor arranged to rotate in timed relation to engine rotation, and a shuttle movably received in an axial bore made in the rotor. Opposite sides of the shuttle define first and second chambers within the axial bore, where the first chamber is used as a compression chamber to pressurize fuel introduced therein via the electromagnetic valve to inject the same into engine cylinders, and the second chamber is communicable with a low pressure fuel reservoir. Fuel is fed into the first and second chambers during an intake stroke or mode, and then the second chamber fuel is pressurized by means of an inner cam mechanism so that the shuttle moves toward the first chamber to pressurize the fuel therein, thereby injecting the fuel during a compression stroke. When the shuttle has been moved toward the first chamber beyond a predetermined position, the second chamber communicates with the low pressure fuel reservoir via a by-pass, lowering fuel pressure in the second chamber to terminate injection. The amount of fuel injected into cylinders is controlled by the stroke of the shuttle toward the first chamber, which stroke is initially determined by the energizing interval of the electromagnetic valve.

6 Claims, 5 Drawing Figures

FUEL INJECTION PUMP FOR INTERNAL COMBUSTION ENGINE

BACKGROUND OF THE INVENTION

This invention relates generally to fuel injection systems for internal combustion engines, and more particularly to a fuel injection pump of a fuel injection system for controlling fuel flow rate supplied to cylinders of a diesel engine.

Conventional distribution type fuel injection pumps are widely used for diesel engines because of their simple structure and small size. Such conventional fuel injection pumps are divided into two sorts the axially movable and rotatable plunger type and the inner cam type having plungers radially received in a rotor. In the former type pump, the fuel is apt to be forcibly introduced into a compression chamber via a relatively narrow passage because the plunger reciprocates in timed relation to engine rotation. As a result, air bubbles are readily introduced into the fuel in the compression chamber. In the latter type pump, since the plungers are apt to move radially outwardly due to centrifugal force, air bubbles are readily introduced into fuel in the compression chamber. Such air bubbles mixed in compressed fuel raise various problems. Namely, accurate fuel amount cannot be ensured, and thus irregular fuel injection is apt to occur.

SUMMARY OF THE INVENTION

The present invention has been developed in order to remove the above-described drawbacks inherent to the conventional fuel injection systems or pumps.

It is, therefore, an object of the present invention to provide a new and useful fuel injection pump, which is capable of accurately controlling the fuel flow without suffering from problems of air bubbles.

According to a feature of the present invention a shuttle is movably received within an axial bore of a rotor which rotates in synchronism with engine rotation, such that first and second chambers are defined at opposite sides of the shuttle, where the first chamber is used as a compression chamber to pressurize fuel for injecting the same into engine cylinders, and the second chamber is communicable with a low pressure fuel reservoir, and the fuel led into the second chamber is periodically pressurized by means of an inner cam mechanism to cause the shuttle to move toward the first chamber. In this way, since the shuttle is moved back and forth in accordance with the pressure difference between the first and second chamber, the fuel led into the first or compression chamber is not forcibly sucked by the shuttle. As a result the fuel pressure within the compression chamber is always kept at a positive value, and therefore, no air bubbles are introduced into the fuel in the first chamber. Furthermore, since the second chamber is communicating with a low pressure fuel reservoir when the inner cam mechanism operates to move the shuttle toward the second chamber, no air bubbles are introduced into the second chamber fuel.

As a result, accurate fuel flow control is ensured, preventing irregular fuel injection.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Figure 1:
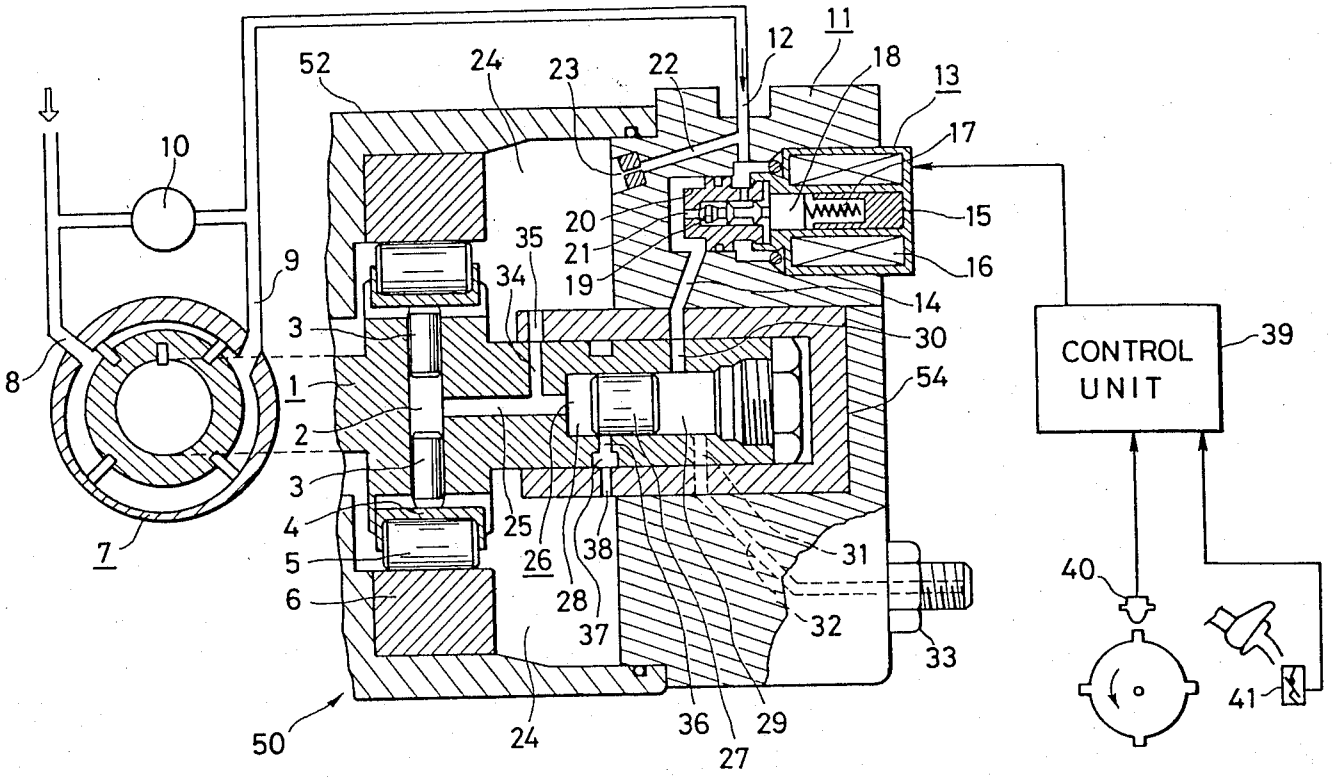
FIG. 1 is a schematic diagram of an embodiment of the invention, showing a fuel injection pump by way of a cross-sectional view.

Referring now to FIG. 1, a schematic diagram of an embodiment of the present invention is shown. The fuel injection apparatus generally comprises a tranfer or feed pump 7, a fuel injection pump 50, a control unit 39, and sensors 40 and 41 in the same manner as in conventional distribution type fuel injection apparatus. As will be described later, the feature of the present invention resides in the structure of the fuel injection pump 50.

The transfer pump 7, which per se is known in the art, receives fuel via a fuel passage 8 communicating with a fuel tank (not shown) to pressurize the introduced fuel and output the pressurized fuel via another fuel passage 9 to the fuel injection pump 50. Between the fuel passages 8 and 9 is provided a pressure adjuster 10 for maintaining the fuel pressure in the passage 9 constant. The fuel passage 9 from the transfer pump 7 communicates with an intake passage 12 of the fuel injection pump 50 so that fuel is led via an electromagnetic valve 13 to an intake port 14.

The fuel injection pump 50 generally comprises a housing 52 and a distribution head 11 in which the electromagnetic valve 13 is built.

The electromagnetic valve 13 comprises a coil 16 arranged around a core 15 which attracts a movable member 18 against the force of a spring 17 on energization of the coil 16. The movable member 18 is connected to a valve 19 which is reciprocally movable in a valve housing 20 having an inlet communicating with the intake passage 12, and an outlet 21 communicating with the intake port 14. Therefore, when the coil 16 is energized, the valve 19 moves right in the drawing to open the same, establishing communication between the intake passage 12 positioned upstream the electromagnetic valve 13, and the intake port 14 positioned downstream the electromagnetic valve 13.

The intake passage 12 is also communicating with a low pressure fuel reservoir 24 via a by-pass 22 having an orifice 23 so that fuel in the intake passage 12 is led into the low pressure fuel reservoir 24 with its pressure being lowered by the orifice 23. Namely, the low pressure fuel reservoir 24 communicates with the intake passage 12 upstream the electromagnetic valve 13 so that fuel can be led into the low pressure fuel reservoir 24 irrespective of the state of the electromagnetic valve 13.

The fuel injection pump 50 comprises a rotor 1 having a radial bore 2 and an axial bore 26 therein communicating with each other. The rotor 1 is rotatably received partially in a cylinder 52 fixedly received in a recess of the distribution head 11. The rotor 1 is arranged to be rotated by a drive shaft of an internal combustion engine (not shown). Within the radial bore 2 is provided a pair of radially movable plungers 3 whose tip portions are arranged to be in contact with the inner surface of a cam ring 6 via shoes 4 and rollers 5. Namely, the plungers 3, shoes 4 and rollers 5 constitute a well known inner cam mechanism so as to intake and pressurize or compress fuel by the reciprocal movement of the plungers 3 each time the rotor 1 makes a full revolution.

The above-mentioned transfer pump 7 has a rotor axially connected to the rotor 1.

The rotor 1 has, within its axial bore 26, a shuttle mechanism as will be described hereinbelow. The above-mentioned axial bore 26 communicates via an axial passage 25 with the radial bore 2, and has an axially movable shuttle 27 defining a first or right chamber 29 and a second or left chamber 28 within the axial bore 26 where these right and left chambers 29 and 28 are hydraulically insulated from each other. The right chamber 29 communicates with a plurality of main intake ports 30 and a distribution port 31. The main intake ports 30 are equiangularly and radially arranged, and the number of the main intake ports 30 equals the number of engine cylinders. Each of the main intake ports 30 of the rotor 1 is arranged to be aligned with the intake port 14 of the distribution head 11, while the distribution port 31 of the rotor 1 is arranged to be aligned with a plurality of distribution ports 32 one after another as the rotor 1 rotates with the outer surface of rotor 1 being aligned at a predetermined cam angle. Fuel fed via the distribution ports 32 is arranged to flow through fittings 33, the number of which equals the number of engine cylinders, to be injected into respective engine cylinders one after another.

The above-mentioned axial passage 25 establishing communication between the left chamber 28 and the radial bore 2, communicates via one of a plurality of equiangularly radially arranged auxiliary intake ports 34 and a passage 35 made in the wall of the cylinder 54 with the low pressure reservoir 24. The passage 35 is located such that its angular position equals that of the intake port 14 of the distribution head 11. With this arrangement, when one of the main intake ports 30 of the rotor 1 is aligned with the intake port 14 to be communicated with each other, one of the auxiliary intake ports 34 of the rotor 1 is also aligned with the passage 35 to be communicated with each other.

The axial bore 26 communicates with a radially arranged by-pass 36 at a substantially midway point between the main intake ports 30 and the auxiliary intake ports 34, which by-pass 36 is normally closed by the outer surface of the shuttle 27. The by-pass 36 communicates with an annular groove 37 made at the outer surface of the rotor 1, which groove 37 is arranged to communicate via a by-pass 38 of the cylinder 54 with the low pressure fuel reservoir 24.

The above-mentioned control unit 39 comprises an electronic circuit, which may be a microcomputer, for calculating optimum fuel flow rate by using various engine parameters as is well known. Namely, an output signal from an accelerator pedal position sensor 41 and an output signal from a rotational angle sensor 40 are respectively applied to supply the control unit 39 with engine speed data and pump cam angle such as a signal indicative of the top dead center of the plunger 3, and with engine load data represented by the position of the accelerator pedal. The accelerator pedal position sensor 41 may comprise a potentiometer whose movable contact is arranged to move in accordance with the stroke of the accelerator pedal, while the rotational angle sensor 40 may comprise an electromagnetic pick-up as is well known in the art. The control unit 39 controls the energizing interval of the electromagnetic valve 13 so as to supply the engine with an optimum fuel amount. Such a control unit is disclosed in co-pending U.S. patent application Ser. Nos. 482,884 and 514,608.

The embodiment of FIG. 1 operates as follows. Fuel from the fuel tank (not shown) is provisionally pressurized by the transfer pump 7 to be applied to the fuel injection pump 50. Let us assume that the electromagnetic valve 13 is closed at first, and then fuel is led into the low pressure fuel reservoir 24 via the orifice 23. Due to the presence of the orifice the pressure of the fuel in the low pressure fuel reservoir 24 is lower than that of fuel in the intake passage 12.

Figure 2:
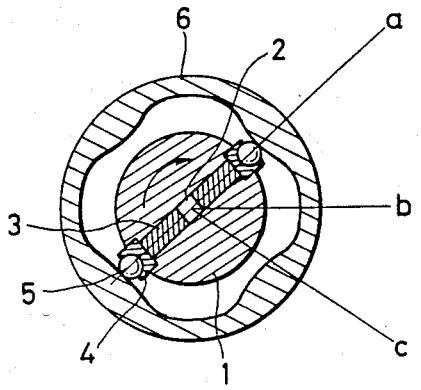
FIG. 2 is an explanatory diagram showing a cross-sectional view of the inner cam mechanism used in the embodiment of FIG. 1.

Referring to FIG. 2 showing the operation of the inner cam including the cam 6, rollers 5 and the plungers 3, as the rotor 1 rotates, the pair of plungers 3 received in the radial bore 2 of the rotor 1 reciprocate. The reference "a" and "b" in FIG. 2 respectively indicate a top dead center and a bottom dead center of the plungers 3. When the plungers 3 start moving radially outwardly after passing the top dead center (see cam angle "a"), one of the main intake ports 30 aligns with the intake port 14, while one of the auxiliary intake ports 34 aligns with the port 35. At this time, the rotational angle sensor 40 produces a top dead center signal which causes the control unit 39 to produce a driving current fed to the electromagnetic valve 13 to energize the same. As the result, the electromagnetic valve 13 opens to establish communication between the intake passage 12 and the intake port 14. The control unit 39 computes an energizing interval which determines an optimum fuel flow. Namely, engine load data and engine rotational speed data from the accelerator position sensor 41 and the rotational angle sensor 40 are used to compute the energizing interval.

Figure 3:
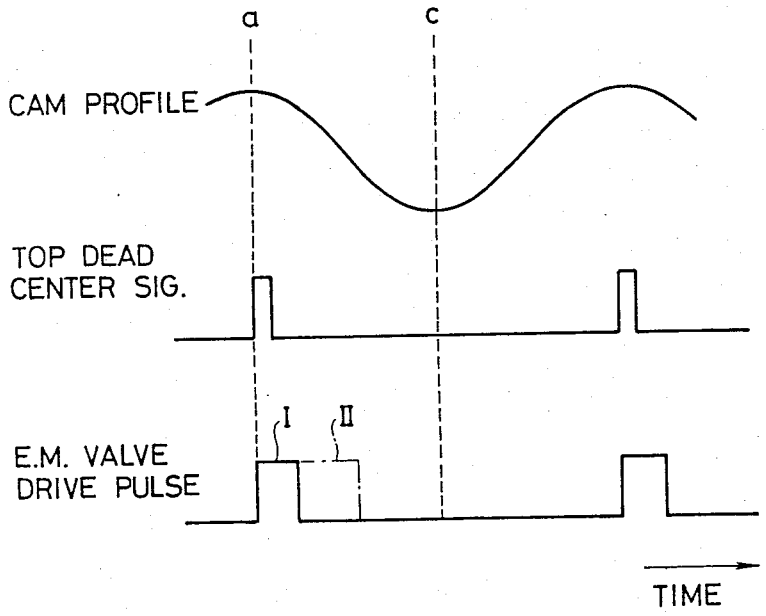
FIG. 3 is a time chart useful for understanding the operation of the electromagnetic valve used in the embodiment of FIG. 1.

FIG. 3 is a timechart showing the relationship between the cam angle, the top dead center signal from the rotational angle sensor 40, and the electromagnetic valve driving signal in the form of a pulse train. A solid line pulse indicates the width of the driving pulse signal used when the engine operates at a relatively low load. Namely, relatively small fuel flow is required on such low load operation. On the other hand, a dotted line pulse indicates the width of the driving pulse signal used when the engine operates at a relatively high load. Namely, relatively large fuel flow is required on such high load operation. In either case, the electromagnetic valve 13 opens when the plungers 3 are at top dead center, and closes before the bottom dead center.

As the electromagnetic valve 13 opens, fuel is introduced into the right chamber 29 via the intake port 14 and one of the main intake ports 30 of the rotor 1. At this time fuel is also introduced into the left chamber 28 from the low pressure reservoir 24. This fuel from the low pressure reservoir 24 is also introduced into the radial bore 2 defined between the plungers 3. With this operation both right and left chambers 29 and 28 located at both sides of the movable shuttle 27 are filled with fuel. Since the fuel pressure in the right chamber 29 is higher than that of the left chamber 28, the shuttle 27 moves left in the drawing. Namely, the shuttle 27 moves toward the left chamber 28 until the right chamber fuel pressure equals the left chamber fuel pressure. Therefore. when the electromagnetic valve 13 is continuously energized for a relatively long period of time, the right chamber fuel pressure becomes larger, causing the shuttle 27 to move left by a relatively large distance. In other words, the longer the energizing interval, the longer the leftward or intake stroke of the shuttle 27.

Figure 4:
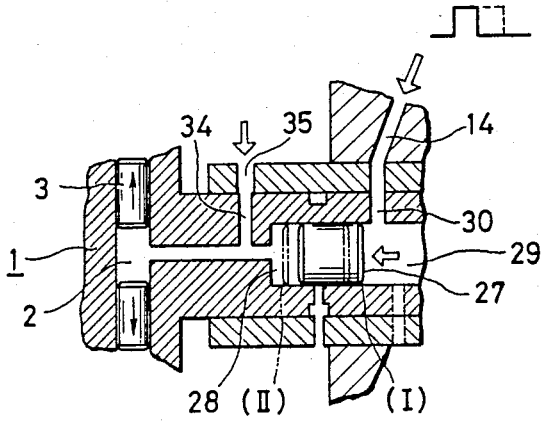
FIGS. 4 and 5 are explanatory diagrams showing intake stroke and compression stroke of the plungers of the inner cam mechanism, and the shuttle both shown in FIG. 1.

FIG. 4 shows the above-mentioned shuttle movement in intake mode or stroke in which fuel is led into the right chamber 29 used as a pressurizing or compression chamber. The shuttle 27 position shown by solid lines (I) is obtained on low engine load, while the shuttle 27 position shown by dotted lines (II) is obtained on high engine load. Namely, the higher the engine load, the more to the left the shuttle stops during intake.

As the rotor 1 further rotates, the main intake port 30 and the auxiliary intake port 34, which have been respectively communicating with the intake ports 14 and 35, are closed, and the electromagnetic valve 13 is deenergized before reaching the bottom dead center (see cam angle "b" in FIG. 2). When the bottom dead center is passed, to enter into a compression mode (see cam angle "c"), the plungers 3 move radially inwardly, coming close to each other so as to compress the fuel in the bore 2. As a result, the fuel in the axial passage 25 and the left chamber 28 is pressurized to cause the shuttle 27 to move right. At this time one of the distribution ports 31 aligns with the distribution port 32 to inject fuel into a given cylinder of the engine. This fuel injecting operation continues until the shuttle 27 moves right so that the by-pass 36 communicates with the left chamber 28. Namely, when the shuttle 27 moves right by a distance so that the by-pass 36 is opened, the fuel in the left chamber 28 is returned via the by-pass 36, the annular groove 37 and the by-pass 38 to the low pressure fuel reservoir 24, thereby lowering the fuel pressure in the left chamber 28. Accordingly, the rightward movement of the shuttle 27 terminates, stopping fuel injection.

Figure 5:
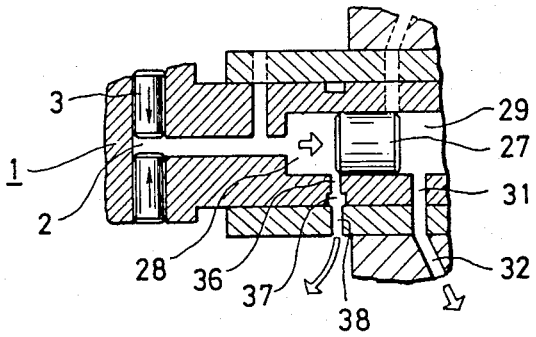

From the above, it will be understood that at the instant plungers 3 are at the bottom dead center, the further that shuttle 27 is to the left in FIGS. 1, 4 and 5, the longer the stroke of the shuttle will be in its compressing operation. Since the fuel flow or fuel injection amount fed to engine cylinders is determined by the rightward or compression stroke of the shuttle 27 in its compression operation, and since the rightward stroke is determined by the leftward or intake stroke of the same as controlled by the electromagnetic energizing interval, the fuel flow can be controlled by the energizing interval of the electromagnetic valve 13.

The above-described embodiment is just an example of the present invention, and therefore, it will be apparent for those skilled in the art that many modifications and variations may be made without departing from the spirit of the present invention.

What is claimed is:

1. A fuel injection pump of a fuel injection system of the type arranged to control the amount of fuel injected into engine cylinders by using an electromagnetic valve, comprising:

(a) a rotor arranged to rotate in synchronism with engine rotation, and having a radial bore and an axial bore communicating with each other, said rotor being rotatably mounted in said fuel injection pump;

(b) an inner cam mechanism having a pair of plungers movably received in said radial bore of said rotor, said plungers being arranged to reciprocate as said rotor rotates to compress fuel between said plungers;

(c) a shuttle axially movable within said axial bore of said rotor, defining first and second chambers within said axial bore;

(d) main fuel intake port means communicable with said first chamber for supplyng fuel thereto when said electromagnetic valve is open, said fuel in said first chamber being compressed when said shuttle moves in a direction from said second chamber toward said first chamber;

(e) a low pressure fuel reservoir for receiving fuel therein, wherein the fuel pressure is lower than that of the fuel in said main fuel intake port means;

(f) auxiliary fuel intake port means for establishing communication between said low pressure fuel reservoir and said axial bore and said second chamber when said rotor assumes predetermined angles;

(g) a by-pass means communicable with said second chamber when said shuttle has been moved toward said first chamber with the fuel pressure within said second chamber being increased by the movement of said plungers, said by-pass communicating with said low pressure fuel reservoir; and (h) fuel distribution passage means communicable with said first chamber for injecting pressured fuel into engine cylinders one after another.

2. A fuel injection pump as claimed in claim 1, wherein said main fuel intake port means comprises an intake port positioned downstream said electromagnetic valve, and a plurality of main intake ports radially arranged within said rotor to communicate with said first chamber, each of said main intake ports of said rotor being aligned with said intake port one after another as said rotor rotates.

3. A fuel injection pump as claimed in claim 1, wherein said auxiliary fuel intake port means comprises a passage communicating with said low pressure fuel reservoir, and a plurality of auxiliary intake ports radially arranged within said rotor to communicate an axial passage which communicates with said second chamber and said axial bore respectively at both ends thereof, each of said auxiliary intake ports of said rotor being aligned with said passage one after another as said rotor rotates.

4. A fuel injection pump as claimed in claim 1, wherein said by-pass passage means comprises a radial passage communicable with said second chamber when said shuttle has been moved toward said first chamber beyond a predetermined point, an annular groove communicating with said radial passage, and a by-pass passage communicating with said annular groove at one end and with said low pressure fuel reservoir at the other end.

5. A fuel injection pump as claimed in claim 1, wherein said low pressure fuel reservoir communicates with a fuel passage upstream said electromagnetic valve via an orifice so that the fuel pressure within said low pressure fuel reservoir is lower than that of fuel in said fuel passage.

6. A fuel injection pump as claimed in claim 1, wherein said rotor is rotatably received in a cylinder which is fixedly received in a recess of a distribution head in which said electromagnetic valve, a portion of said main fuel intake port means and a portion of said fuel distribution passage means are built.

* * * * *